US010619292B2

(12) United States Patent
Malpass et al.

(10) Patent No.: US 10,619,292 B2
(45) Date of Patent: Apr. 14, 2020

(54) INDIGO DYEING PROCESS AND APPARATUS AND INDIGO DYED YARNS AND FABRICS MADE THEREBY

(71) Applicant: INDIGO MILL DESIGNS, INC., Ronda, NC (US)

(72) Inventors: Howard Malpass, China Grove, NC (US); Ralph Tharpe, Ronda, NC (US); M. Dean Ethridge, Lubbock, TX (US)

(73) Assignee: INDIGO MILL DESIGNS, INC., Ronda, NC (US)

( * ) Notice: Subject to any disclaimer, the term of this patent is extended or adjusted under 35 U.S.C. 154(b) by 0 days.

(21) Appl. No.: 15/701,840

(22) Filed: Sep. 12, 2017

(65) Prior Publication Data

US 2018/0073192 A1 Mar. 15, 2018

Related U.S. Application Data

(60) Provisional application No. 62/393,258, filed on Sep. 12, 2016.

(51) Int. Cl.

| | |
|---|---|
| ***D06P 1/22*** | (2006.01) |
| ***D06P 5/02*** | (2006.01) |
| ***D06B 23/18*** | (2006.01) |
| ***D06B 21/00*** | (2006.01) |
| ***D06B 23/16*** | (2006.01) |
| ***D06B 1/14*** | (2006.01) |
| ***D06B 1/02*** | (2006.01) |
| ***D06B 19/00*** | (2006.01) |
| ***D06B 5/06*** | (2006.01) |

(52) U.S. Cl.

CPC ..... *D06P 1/228* (2013.01); *D06B 21/00* (2013.01); *D06B 23/16* (2013.01); *D06B 23/18* (2013.01); *D06P 5/02* (2013.01); *D06B 1/02* (2013.01); *D06B 1/14* (2013.01); *D06B 5/06* (2013.01); *D06B 19/0005* (2013.01); *D06B 19/0094* (2013.01)

(58) Field of Classification Search

CPC .... D06P 1/02; D06P 1/14; D06P 1/228; D06P 5/02; D06P 5/06; D06B 21/00; D06B 23/16; D06B 23/18; D06B 19/005; D06B 19/0094

See application file for complete search history.

(56) References Cited

U.S. PATENT DOCUMENTS

| | | | | |
|---|---|---|---|---|
| 2,834,193 | A * | 5/1958 | Fahringer | D06B 23/18 68/5 E |
| 2,878,778 | A * | 3/1959 | Kusters | D06B 15/02 68/99 |
| 4,699,627 | A | 10/1987 | Bailey | |
| 5,378,246 | A | 1/1995 | Gurley | |
| 5,494,491 | A | 2/1996 | Gurley | |
| 5,611,822 | A * | 3/1997 | Gurley | C09B 7/02 8/111 |
| 5,922,084 | A | 7/1999 | Fuchs et al. | |
| 5,976,196 | A | 11/1999 | Cooper et al. | |
| 6,090,157 | A | 7/2000 | Traut et al. | |
| 6,428,581 | B1 | 8/2002 | Gäng et al. | |
| 7,913,524 | B2 | 3/2011 | Aurich et al. | |
| 8,060,963 | B2 | 11/2011 | Ronchi | |
| 8,167,958 | B2 * | 5/2012 | Meyer | D06B 1/02 8/477 |
| 8,215,138 | B2 | 7/2012 | Ronchi | |
| 2005/0241078 | A1 | 11/2005 | Aurich et al. | |
| 2009/0000042 | A1 | 1/2009 | Ronchi | |
| 2009/0265867 | A1 * | 10/2009 | Ronchi | D06B 19/0005 8/477 |

FOREIGN PATENT DOCUMENTS

| | | |
|---|---|---|
| EP | 1 703 008 | 9/2006 |

OTHER PUBLICATIONS

A. Vuroema, "Reduction and Analysis Methods of Indigo", Reduction and Analysis Methods of Indigo, ISBN978-951-29-3781-3, Turun Yliopiston Julkaisuja Annales Universitatis Turkuensis (2008), 72 pages.

International Search Report and Written Opinion, PCT/2017/051089, dated Nov. 17, 2017.

* cited by examiner

*Primary Examiner* — Amina S Khan

(74) *Attorney, Agent, or Firm* — Nixon & Vanderhye P.C.

(57) ABSTRACT

Processes and apparatus are disclosed which substantially eliminate the formation of oxidized indigo dye before and during dye application onto a natural fiber yarn or fabric while allowing the leuco-indigo dye molecule to diffuse fully into the natural fibers of the yarn where it can fix to the fibers prior to oxidation (i.e., exposure of the leuco-dyed yarns to oxygen). Indigo dyed textile products (e.g., dyed cotton yarns that may be twill woven to form a denim fabric) exhibit exceptionally high colorfastness as determined by the AATCC Crock Test.

22 Claims, 2 Drawing Sheets

INDIGO DYEING PROCESS AND APPARATUS AND INDIGO DYED YARNS AND FABRICS MADE THEREBY

CROSS-REFERENCE TO RELATED APPLICATION

The present application is based on and claims priority benefits from U.S. Provisional Application Ser. No. 62/393,258 filed on Sep. 12, 2016, the entire contents of which are incorporated herein by reference.

FIELD

The embodiments disclosed herein relate generally to an indigo dyeing process and apparatus suitable for indigo dyeing of natural and regenerated natural fibers (e.g. cotton, wool, rayon and other biopolymers) using a low wet pick-up application, such as foam. Indigo dyed yarns and fabrics formed of such indigo dyed yarns (e.g., denim fabrics) made by such processes are also provided which exhibit exceptionally high colorfastness (both wet and dry).

BACKGROUND

Conventional commercial dyeing with indigo is well known. According to one conventional indigo dyeing method, a sheet of yarns is dyed by sequentially dipping (with a high wet pick-up of about 65%-75%) in leuco-indigo in several indigo dye vats allowing air to oxidize the dye on the yarns after each dip. Another conventional indigo dyeing method involves a series of ropes of yarns each containing about 400 individual yarns that are dyed in a series of indigo dye vats in a similar manner. The sheet dyeing method generally also includes a step of applying sizing to the yarns in preparation for weaving. The rope dyeing method has the disadvantage that the individual dyed ropes must be opened (re-beaming) so the yarns in the rope can be combined at sizing to make the necessary number of ends for a full width warp. These additional steps are self-evidently labor intensive and problematic due to yarn breakages.

The conventional rope dyeing method allows for continuous operation as one rope can be tied to the tail of another. The sheet dyeing method on the other hand must be stopped and reset with full input beams which thereby results in substantial waste and potential color changes from one lot of yarns to another.

Conventional indigo dyeing methods employ large amounts (e.g., on the order of several thousands of liters) of dye bath which, due to cost and environmental concerns must be stored for the next use. By way of example, a commercial indigo dye house might have several baths stored in preparation for future use. When needed the entire dye range must be emptied and refilled with the appropriate bath or the existing bath must be adjusted in concentration. This changeover time thereby reduces the efficiency of the ranges and reduces quality because the leuco-indigo dye tends to oxidize over time in storage.

The conventional indigo dyeing methods are also relatively slow, e.g., generally operating in the range of 20-35 meters per minute, and use excessive volumes of water and chemical additives. By way of example, in order to maintain the condition of the leuco dye, reducer and caustic additives are typically added to the dye vat so as to prevent the buildup of oxidized indigo dye that will contaminate the system and the yarn being dyed. Overflow frequently results from the volumes of chemical additives. The machinery needed for conventional indigo dye systems are also energy intensive due to the required yarn drying and the needed horsepower to pull large quantities of wet yarn.

There has been a trend in the market for beams from the rope system (after opening or re-beaming) to be threaded to various take-up mechanisms to wind each yarn back into cones. Such yarns are used in accent stripes, in the weft of various fabrics, or in knits. The demand for such indigo dyed yarns recovered to cones is increasing. Both conventional indigo dyeing systems are directed toward high volume and are thereby not conducive to rapidly changing customer demands for fashion, especially stretch yarns in warp direction, which are harder to process in either of the conventional systems.

It has also been suggested that conventional indigo dyeing processes are not environmentally sustainable due to the large amounts of water and energy that are consumed in addition to the use of chemical additives, such as reducers and caustic agents which generate salts and high alkalinity in the wastewater. Such wastewater is typically capable of being neutralized using sulfuric acid at conventional waste treatment facilities. But in many underdeveloped countries, little or no wastewater treatment is available, resulting in environmental contamination.

Indigo dyeing methods are also known that involve low wet pick up techniques; for example, the use of indigo dye foam and aerosol spray. However, these techniques face the additional problem of high exposure to oxygen due the surface area of the bubble (inside and out) or to the surface area of the aerosol droplets. For this reason nitrogen is used to create an inert atmosphere.

For example, U.S. Pat. No. 8,215,138 (the entire contents of which are incorporated expressly hereinto by reference) describes the benefits of using nitrogen in a sealed container over the dye bath and further teaches the use of a dwell chamber. U.S. Pat. Nos. 8,167,958, and 7,913,524 (the entire contents of each such patent being expressly incorporated hereinto by reference) propose low wet pick-up methods and require a reduction in the oxygen present further suggesting a nitrogen medium, however, neither patent specifies what level of oxygen contamination they require in each element of the system, nor do they propose to measure the actual oxygen content in the system. None of these known systems has demonstrated the success required to replace conventional sheet or rope indigo dyeing. An overview of conventional indigo dyeing can be found in the literature, for example, in Vuorema, Anne, *Reduction and Analysis Methods of Indigo*, ISBN978-951-29-3781-3, Turun Ylioopiston Julkaisuja Annales Universitatis Turkuensis (2008), the entire content of which is expressly incorporated hereinto by reference.

An indigo dyeing process and apparatus for natural yarns and fabrics that could solve the deficiencies in conventional indigo dyeing systems as discussed above, as well as the previously proposed low wet pick up processes, would be of great utility, especially in countries where water is scarce and/or energy is expensive. It is towards providing such solutions that the embodiments of the herein disclosed invention are directed.

SUMMARY

In general, the embodiments disclosed herein are directed toward processes and apparatus which substantially reduce the superficial oxidized indigo on yarn or fabric by allowing the leuco dye molecule to diffuse more fully into the yarn or fabric where it can fix within the fibers after oxidation (i.e., exposure of the leuco-dyed yarns to oxygen).

According to certain embodiments, process and apparatus are disclosed whereby an undyed textile product (e.g., a sheet of yarns formed of natural spun fibers) are introduced into an oxygen purge chamber having an inert atmosphere. The deaerated undyed textile product is then transferred from the purge chamber to a dye application chamber having an anaerobic atmosphere where a reduced indigo dye solution is brought into contact with the textile product. The reduced indigo dyed textile product may then be discharged from the dye application chamber into a dwell chamber and then into an oxygen-containing atmosphere to oxidize the reduced indigo dye applied to the textile product and thereby form an indigo dyed textile product.

Importantly, before discharging the reduced indigo dyed textile product into the oxygen-containing environment, it is transferred from the dye application chamber and into a dwell chamber having an anaerobic atmosphere where the reduced indigo is enabled to penetrate into the product. This atmosphere is also temperature/humidity controlled.

Roller seal assemblies may be provided at each inlet and outlet of the chambers so as to seal the atmospheres therein against oxygen ingress. In this regard, the purge chamber and the dye application chamber are operated at an atmospheric pressure greater than ambient atmospheric pressure, and the pressure within the dye application chamber is greater than the pressure within the purge chamber.

The purge chamber may comprise a purification system in fluid communication with the inert atmosphere of the purge chamber. The dye application chamber may comprise a purification control unit to control oxygen content of the anaerobic atmosphere within the dye application chamber. If present, the dwell chamber may comprise a moisture generator to control relative humidity of the anaerobic atmosphere within the dwell chamber.

The indigo-dyed textile product produced according to the embodiments disclosed herein will exhibit exceptionally high colorfastness as determined by the AATCC Crock Test. Specifically, significantly higher wet and dry crock values are achieved as compared to conventional indigo-dyed products.

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

DETAILED DESCRIPTION

A. Definitions

As used herein and in the accompanying claims, the terms below are intended to have the following definitions:

"Filament" means a fibrous strand of extreme or indefinite length.

"Fiber" means a fibrous strand of definite or short length, such as a staple fiber.

"Yarn" means a collection of numerous filaments or fibers which may or may not be textured, spun, twisted or laid together.

"Woven fabric" means a fabric composed of two sets of yarns, warp and filling, and formed by interlacing (weaving) two or more warp yarns and filling yarns in a particular weave pattern (e.g., plain weave, twill weave and satin weave). Thus, during weaving the warp and fill yarns will be interlaced so as to cross each other at right angles to produce the woven fabric having the desired weave pattern.

"Denim fabric" is a woven warp-faced fabric formed of cotton yarns in which the weft yarns pass under two or more warp yarns to form a twill weave which produces a diagonal ribbing, whereby the warp yarns are indigo dyed and the weft yarns are undyed.

"Anaerobic" refers to a chamber or space which is devoid (zero ppm) of free oxygen.

"Natural fibers" are fibers that are formed in nature, for example, cellulosic fibers, cotton fibers, wool fibers and the like.

"Synthetic fibers" are fibers that are man-made, for example, nylon fibers, polyester fibers, polyolefin fibers and regenerated cellulosic fibers such as rayon.

"Wet Crock" and "Dry Crock" are measurements of a dyed textile product's color fastness as determined according to the test methods of American Association of Textile Chemists and Colorists (AATCC) Test Method 8-2016, Colorfastness to Crocking: Crockmeter Method, the entire content of which is expressly incorporated hereinto by reference and may sometimes be referenced herein as the "AATCC Crock Test".

"Wet pick-up" is the weight percent of liquid indigo dye on the fiber substrate, e.g., yarn or fabric, at the time of indigo dye oxidation.

B. Description of Preferred Embodiments

As is schematically depicted below in formula (I), an indigo dye molecule may be reduced to its leuco form by contact with, e.g., sodium dithionite, which in turn may then be reconverted to an indigo dye molecule via oxidation (e.g., exposure to an oxygen-containing environment, typically atmospheric air).

Formula (I)

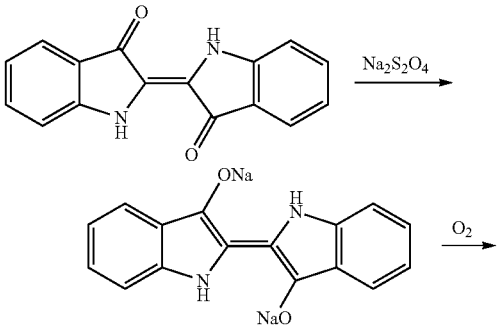

-continued

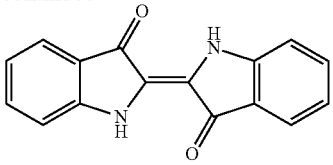

The indigo dye molecule is deep blue in color whereas the leuco form of the molecule is yellowish in color. It is the leuco form of the indigo dye molecule (sometimes hereinafter more simply referenced as "leuco-indigo") which is employed in the practice of the embodiments described herein. The leuco-indigo (sometimes referenced in the art as "pre-reduced indigo") may be obtained from various commercial sources, for example, from DyStar Textilfarben GmbH & Co., manufactured according to U.S. Pat. No. 6,428,581 (the entire content of which is expressly incorporated hereinto by reference).

Figure 1:
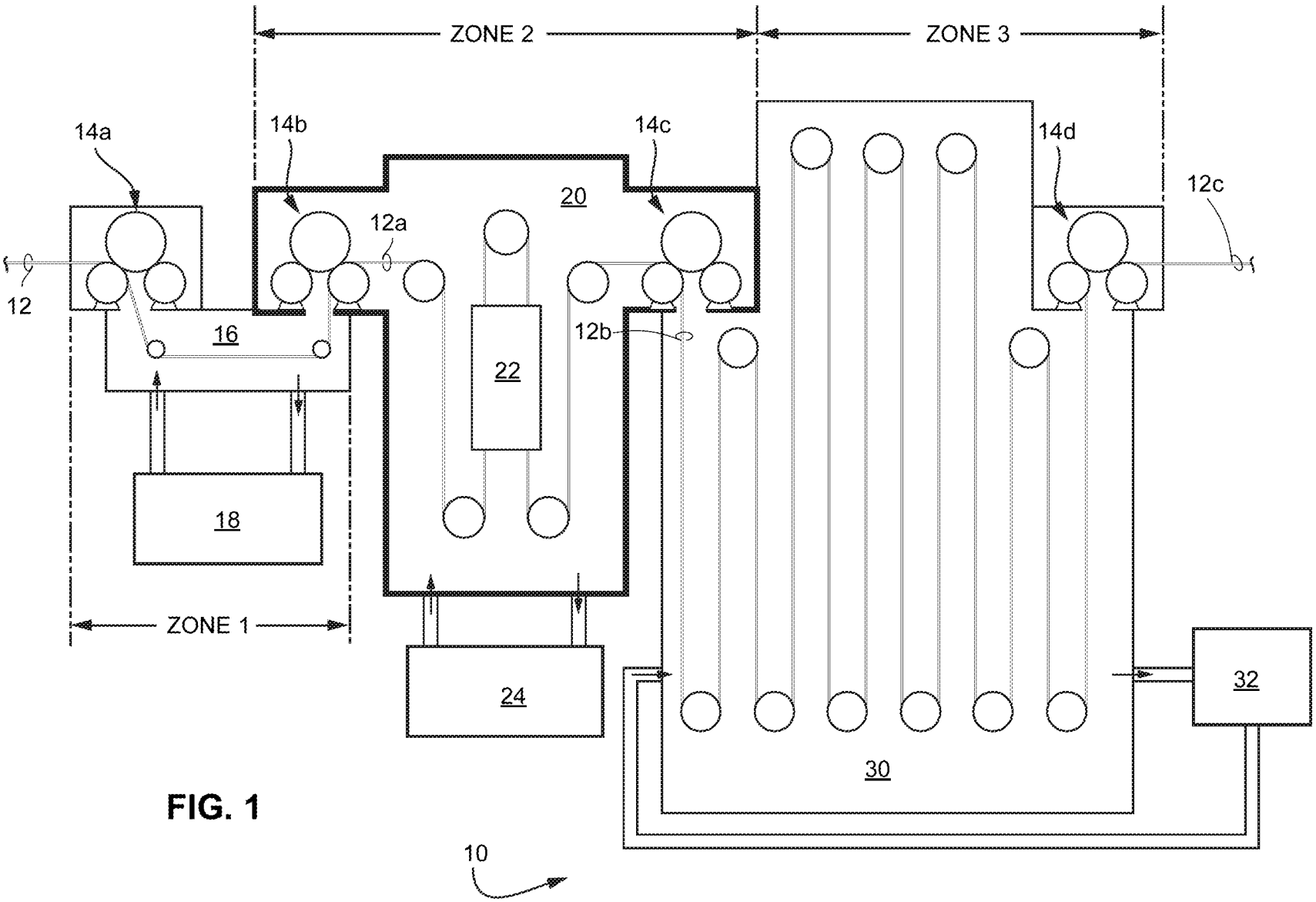
FIG. 1 is a schematic diagram of a low wet-pick-up indigo dyeing apparatus in accordance with an embodiment of the invention described herein.

An exemplary embodiment of an indigo dyeing apparatus 10 in accordance with the invention described herein is shown in accompanying FIG. 1. As depicted, the apparatus 10 is especially adapted to dyeing a sheet of adjacent undyed yarns, schematically depicted by reference numeral 12, which are positioned in a closely packed (dense) side-by-side relationship. The apparatus 10 generally includes three distinct anaerobic zones identified by Zone 1, Zone 2 and Zone 3. The entrances and exits of each of the Zones 1-3 are provided with a roller seal assemblies 14*a*-14*d* which will be described in greater detail below. Suffice it to say, the purpose of the roller seal assemblies 14*a*-14*b* is to enable the exclusion of oxygen after is has been substantially removed from the atmosphere and from the fiber interstices of the yarns 12 and to prevent the ingress of ambient oxygen into the chambers of the apparatus 10.

The sheet of yarns 12 introduced into the apparatus 10 will have a density of less than about 2.0 yarns per millimeter, typically less than about 1.5 yarns per millimeter. The width of the sheet of yarns 12 will thus vary in dependence on the maximum density allowed by the individual yarn size. A sheet of yarns 12 having fewer yarn ends may have several advantages over the rope dyeing systems employed conventionally. For example, the yarns within the sheet need to lie side-by-side and not cross over each other since yarns that cross will cause some of the yarns to be physically masked from the dye applicator and thereby may not receive color. The number of yarns 12 in the sheet may vary widely depending on various conditions. For example, small sampling, testing and micro production runs may have at least about 40 yarn ends in the sheet, while commercial production runs may have between 400 to 480 yarn ends or more in the sheet.

The sheet of yarns 12 thus enter the apparatus 10 through a first roller seal assembly 14*a* so as to be guided through a pressurized substantially anaerobic purge chamber 16 supplied with a nitrogen environment. The purpose of the purge chamber 16 is to ensure that the sheet of yarns 12 contains minimal (i.e., less than about 30 ppm, preferably less than about 15 ppm and typically less than about 10 ppm) of entrained oxygen. If the measurable oxygen with the purge chamber 16 is more than about 30 parts per million (ppm) in the purge chamber, depending on the yarn properties and the bulk and density of the yarn sheet, a purification system 18 which includes regenerable catalytic purifiers, such as PureGuard™ made by Johnson Matthey USA, may be activated to force a flow of nitrogen gas through the sheet of yarns 12 during its dwell time within the purge chamber 16. The nitrogen gas may thus be purified within the system 18 so that purified nitrogen gas is exhausted back into the purge chamber 18.

The deaerated (deoxygenated) sheet of yarns now designated by reference numeral 12*a* exits the purge chamber 16 through a second roller seal 14*b* and enters the anaerobic dye application chamber 20 positioned in Zone 2 of the apparatus 10. The oxygen-purged sheet of yarns 12*a* are thereby directed by suitable guide rollers within the dye application chamber 20 through a dye applicator 22 whereby leuco-indigo is applied onto the yarns. The dye applicator 22 may be any suitable applicator for textile yarns that allows for low wet pick-up of the leuco-indigo. A suitable dye applicator 22 will thus be capable of operating in a range of between about 15% to about 60% wet dye pick-up, preferably 30% or less wet dye pick-up, applied to the yarns. Suitable applicators include those that apply a liquid medium to the yarns in single or multiple applications by spray, foam, kiss rolls in a singular application. Preferably, the leuco-indigo is supplied to the applicator 22 from a source thereof (not shown) in the form of an oxygen-free foam whereby between 2 to 8 applications of the foam leuco-indigo is applied onto the sheet of yarns 12*a* before exiting the dye application chamber 20 as a sheet of indigo dyed yarns designated by reference numeral 12*b*.

The oxygen-free (nitrogen) atmosphere within the dye application chamber 20 may be circulated through a humidity and pressure control unit 24 which serves to control the atmosphere within the dye application chamber 20 and thereby assist in controlling the wet-pick up of dye by the yarns 12*a*.

The sheet of dyed yarns 12*b* exits the dye application chamber 20 through a third roller seal assembly 14*c* and enters an anaerobic dwell chamber 30 positioned within Zone 3 of the apparatus. The sheet of dyed yarns 12*b* is thus passed in a serpentine manner about guide rollers within the dwell chamber 30 so as to provide sufficient dwell time therewithin to allow the leuco indigo to diffuse into the interstices of the fibers forming the yarns 12*b* and attach to the fibers. The oxygen-free (nitrogen) atmosphere within the dwell chamber 30 may be circulated through a moisture control unit 32 which serves to control the moisture level of the atmosphere within the dye application chamber The dyed yarns (now referenced by numeral 12*c*) exit the dwell chamber 30 through the fourth roller seal assembly 14*d* and pass into an oxidation and drying section (see FIG. 3) and then onto a suitable beam or package wind-up device (not shown in FIG. 1). Upon exiting the dwell chamber 30, the dyed yarns 12*b* will thus be exposed to ambient oxygen conditions to thereby oxidize the indigo dye molecule.

The anaerobic conditions inside the dwell chamber 30 provide sufficient moisture that is needed during the dyeing process so as to allow the leuco-indigo to be diffused within the fibers of the yarns 12*b*. The moisture, temperature, and length of dwell parameters within the dwell chamber 30 are set based on a measurement of the levelness of the dye, but typically the moisture content or relative humidity (RH) within the dwell chamber 30 will be between about 90% to about 100%, typically between about 99% to about 100%. In order to achieve the desired moisture content (relative humidity) within the dwell chamber 30, a moisture generator 32 may be operatively connected to the atmosphere within the dwell chamber 30 so as to constantly generate and recover water vapor in order to maintain constant humidity conditions without condensation drips on the yarn within the chamber 30.

In order to further assist in maintaining a zero ppm oxygen content within the dye chamber 20, it is preferred that the dye chamber 20 be operated at a pressure condition which is greater as compared to the pressure conditions within each of the purge chamber 16 and dwell chamber 30. According to certain embodiments, therefore, the dye chamber 20 has a pressure condition which is between about 3% to about 15% greater than the pressure conditions in each of the purge chamber 16 and dwell chamber 30. By way of example, the pressure conditions within the purge chamber 16 is between about 0 (atmospheric pressure) and 5 inches of water while the pressure condition within the dwell chamber 30 may be within a range of between about 0.2 to about 5.0 inches of water. The pressure condition within the dye chamber 20 will have a pressure condition between about 0.5 to about 70 inches of water column.

Figure 2:
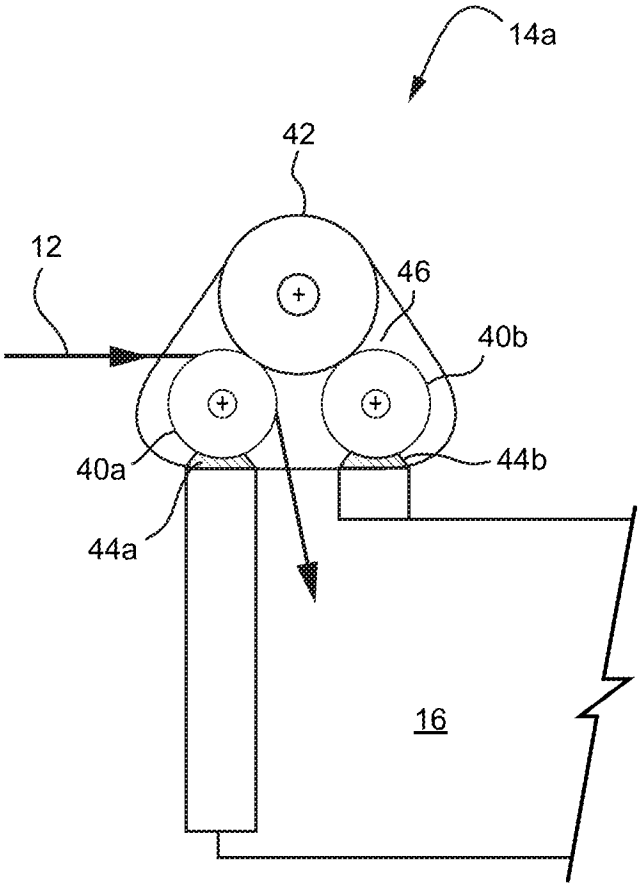
FIG. 2 is an enlarged detailed schematic representation of a roller seal assembly employed in the dyeing apparatus of FIG. 1 which assists in maintaining an anaerobic atmosphere therewithin.

The roller seal 14*a* is depicted in accompanying FIG. 2 and is an exemplary representation of all rollers seals 14*b*-14*d* that are depicted in FIG. 1. As shown, the roller seal 14*a* includes a spaced apart pair of support rolls 40*a*, 40*b* and a pressure roll 42 positioned between and in operable contact with the rolls 40*a*, 40*b*. The pressure roll 42 exerts pressure against the exterior surfaces of each of the support rolls 40*a*, 40*b* and thereby effectively compresses the travelling sheet of yarns 12. Each of the rolls 40*a*, 40*b* and 42 is mounted for rotational movement about its central longitudinal axis between opposed mounting plates 46 (it being understood that only a single mounting plate 46 is depicted in FIG. 3 for clarity).

Each of the support rolls 40*a*, 40*b* is in sliding contact with stationary solid low-friction seals 44*a*, 44*b*, respectively, formed of a lubricious material, e.g., polytetrafluoroethylene (PTFE). Each of the seals 44*a*, 44*b* is conformably shaped so as to engage the exterior surface of the rolls 40*a*, 40*b*, respectively, when rotating. Since the sliding contact between the seals 44*a*, 44*b* and the support rolls 40*a*, 40*b* and between the rolls 40*a*, 40*b* and 42 and the end plates 46 can over time generate heat even though low friction materials are employed to form the seals 44*a*, 44*b* and the end plates 46. As such, it may be desirable to provide a cooling system for the seals 44*a*, 44*b* and end plates 46, e.g., by having such structures in thermal communication with a cooling block and/or by circulating a cooling media (e.g., liquid nitrogen) through the support rolls 40*a* and 40*b*.

The support rolls 40*a*, 40*b* are preferably constructed from a hard material, e.g. stainless steel, coated with diamond like coating (DLC) or a ceramic material to reduce the friction created by sliding contact with seals 44*a* and 44*b*. Conversely, the pressure roll 42 is preferably constructed from or at least have an outer surface region formed of a relatively soft material, e.g., a rubber-like material having Shore D hardness (ASTM D2240) of between about 65 to 85, preferably around 70. In this manner, therefore, the yarns will be squeezed between the softer pressure roll 42 and the harder support rolls 40*a*, 40*b* thereby establishing a reliable seal between the upstream environment and the downstream environment. An alternative four-roll embodiment of a roller seal that may be used in the practice of this invention is disclosed in EP 1703008, the entire content of which is expressly incorporated hereinto by reference.

Figure 3:
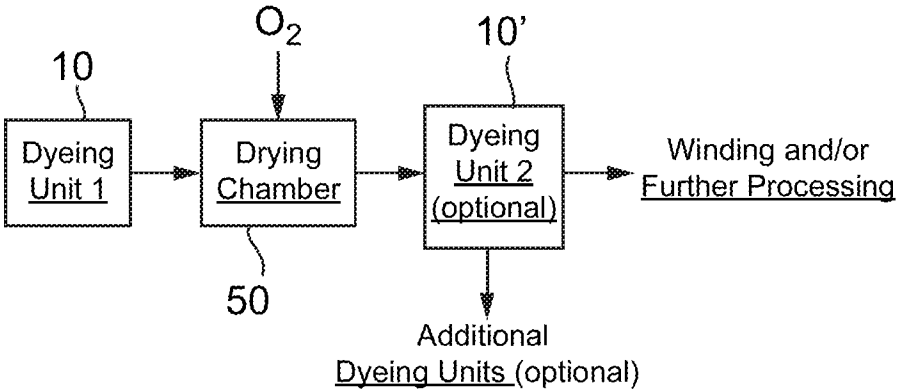
FIG. 3 is a schematic diagram of an exemplary dyeing system that may include at least one apparatus as depicted in FIG. 1.

An exemplary system to form indigo dyed textile products is schematically depicted in accompanying FIG. 3. As shown, the system will include at least one dyeing unit comprising the apparatus 10 as depicted in FIG. 1 so as to allow the indigo dyed yarns 12*c* to be introduced into a downstream drying chamber 50. The atmosphere within the drying chamber 50 may be anaerobic, in which case the dyeing chamber 10 may be positioned immediately downstream of the zone 3 dwell chamber 30 of apparatus 10 and include a roller seal similar to seal 14*a* at a discharge opening thereof. Alternatively, the drying chamber 50 may be provided with an oxygen-containing atmosphere (e.g., by having oxygen gas introduced thereinto or by exposing the drying chamber 50 to atmospheric oxygen. Following the drying chamber 50, the yarns 12*c* may be further indigo-dyed by being transferred to an additional dyeing unit 10' (dyeing unit 2) similar to dyeing unit 1 for further dyeing or may be taken up by suitable winders and/or further processing. Upon exiting the optional dyeing unit 10' (dyeing unit 2), the indigo dyed textile product may similarly be further dyed with additional dyeing units or taken up by winding mechanisms and/or subjected to further processing.

The embodiment as described above has resulted in indigo dyed yarns and fabrics exhibiting exceptionally high color fastness as evidenced by the Wet and Dry Crock values according to the AATCC Crock Test. Specifically, yarns and fabrics produced by the methods and apparatus as disclosed herein exhibit exceptionally high Wet Crock values of at least about 2.0, typically at least about 2.5 and usually at least about 3.0 and greater. In comparison, conventional indigo dyed yarns and fabrics will typically not exceed a Wet Crock value of 1.5, with 1.0 being typically commercially acceptable for current indigo dyed products in the industry.

The exact reason why the dyed textile products of the present invention exhibit such exceptionally high colorfastness is not fully understood at this time. However, it is proposed that since the embodiments disclosed herein operate in a completely anaerobic environment and since entrained oxygen within the interstices of the fibers of the yarns to be dyed is removed to a substantial (if not an entire) extent, minimal amount of superficial leuco indigo is oxidized when the dye is applied. As such, a greater amount of the applied leuco-indigo is fixed within the yarn. In contrast, conventional indigo dyeing techniques expose the superficial dye to oxidation and fixation upon the surfaces of the fibers and yarns where it is more easily removed.

These and other attributes and advantages of the invention will become more clear after consideration of the following non-limiting Example.

C. Examples

Two different samples of denim cotton twill weave fabrics were tested for colorfastness using the AATCC Crock Test. The denim fabrics were identical to one another except for the manner in which the cotton yarns were dyed. Fabric 1 in accordance with the invention included cotton yarns that had been dyed using the apparatus described above in FIGS. 1 and 2, whereas Fabric 2 included cotton yarns that had been dyed using a conventional rope dyeing indigo vat method according to the prior art. Each indigo dyed fabric was graded according to the AATTC Crock Test standards using a scale of 1 (being the lowest colorfastness) to 5 (being the highest colorfastness). The results are noted in Table 1 below.

TABLE 1

AATCC Crock Test Results

| AATCC Crock Test | Fabric 1 (Invention) | Fabric 2 (Prior Art) |
|---|---|---|
| Dry Crock value | 4.5 | 3.0 |
| Wet Crock value | 3.0 | 1.5 |

As noted by the AATCC Crock test results in Table 1 above, the indigo-dyed denim fabric of the invention exhibits substantially higher Dry and Wet Crock values as compared to the prior art fabric. These results are especially surprising since the techniques of the invention as described herein achieve exceptionally high colorfastness without any reducer or caustic chemicals being added to the dye system as is otherwise needed with conventional dyeing systems, no washing of the yarns was done on the range after dye application. In addition, the techniques of the invention created no wastewater discharge but instead any water used was simply evaporated from the yarn upon drying. Thus, the techniques of the invention are both highly economical and environmentally friendly while producing an indigo dyed product of exceptionally high colorfastness.

Various modifications within the skill of those in the art may be envisioned. Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope thereof.

What is claimed is:

1. A continuous process for indigo dyeing of textile products comprising the steps of:

(a) introducing an undyed textile product into an oxygen purge chamber having an inert atmosphere, the purge chamber comprising a purification system in fluid communication with the inert atmosphere therein;

(b) transferring the undyed textile product from the purge chamber to a dye application chamber having an anaerobic atmosphere;

(c) applying a leuco-indigo dye solution onto the undyed textile product within the anaerobic dye application chamber to form a leuco-indigo dyed textile product;

(d) transitioning the leuco-indigo dyed textile product from the dye application chamber into an anaerobic dwell chamber to complete diffusion of the leuco-indigo dye within fibers of the textile product; and (e) discharging the leuco-indigo dyed textile product into an oxygen-containing atmosphere to oxidize the leuco-indigo dye applied to the textile product and thereby form an indigo-dyed textile product.

2. The process according to claim 1, which further comprises between steps (d) and (e) a step of:

(f) transferring the leuco-indigo dyed textile product to a drying chamber having an anaerobic atmosphere to dry the leuco-indigo dyed textile product.

3. The process according to claim 1, which further comprises the step of advancing the undyed textile product through roller seal assemblies positioned at least at an inlet of the purge chamber and an outlet of the dwell chamber.

4. The process according to claim 3, wherein each of the roller seal assemblies comprises a pair of support rolls and a pressure roll in contact with the support rolls.

5. The process according to claim 4, wherein at least an outer surface region of the support rolls is formed of a relatively hard material, and at least the outer surface of the pressure roll is formed of a relatively soft material.

6. The process according to claim 4, wherein the support rolls are in sliding contact with a stationary solid low-friction seal member.

7. The process according to claim 1, wherein the dye application chamber is operated at a pressure condition which is greater than ambient atmospheric pressure, and wherein the pressure condition of the dye application chamber is greater than pressure conditions of the purge chamber and the dwell chamber.

8. The process according to claim 1, wherein the dye application chamber comprises a humidity and pressure control unit to control the anaerobic atmosphere within the dye application chamber.

9. The process according to claim 2, wherein the dwell chamber includes a moisture generator to control relative humidity of the anaerobic atmosphere within the dwell chamber.

10. The process according to claim 1, wherein the inert atmosphere within the purge chamber comprises nitrogen gas, and wherein step (a) comprises the steps of:

(a1) purifying the nitrogen gas within the purge chamber by withdrawing nitrogen gas from the purge chamber, (a2) flowing the withdrawn nitrogen gas through the purification system to form purified nitrogen gas, and thereafter (a3) introducing the purified nitrogen gas into the purge chamber.

11. The process according to claim 10, wherein the purification system comprises a regenerable catalytic purifier to remove oxygen from the nitrogen gas withdrawn from the purge chamber.

12. The process according to claim 1, wherein step (a) comprises:

(a1) determining measurable oxygen in the inert atmosphere of the purge chamber; and (a2) activating the purification system to remove oxygen from the inert atmosphere in response to a determination according to step (a1) that the measurable oxygen is more than a predetermined amount.

13. The process according to claim 12, wherein step (a2) comprises:

(i) withdrawing the inert atmosphere containing an amount of measurable oxygen from the purge chamber;

(ii) removing the measurable oxygen from the inert atmosphere by the purification system until the amount of the measurable oxygen is below the predetermined amount to thereby obtain purified inert atmosphere, and (iii) returning the purified inert atmosphere to the purge chamber.

14. The process according to claim 13, wherein the inert atmosphere comprises nitrogen gas.

15. The process according to claim 13, wherein the predetermined amount of measurable oxygen is 30 ppm.

16. The process according to claim 13, wherein the predetermined amount of measurable oxygen is 15 ppm.

17. The process according to claim 13, wherein the predetermined amount of measurable oxygen is 10 ppm.

18. The process according to claim 13, wherein the textile product is a sheet of textile yarn ends arranged side-by-side.

19. The process according to claim 18, wherein the sheet of yarn ends has a density of less than about 2.0 yarns per millimeter of sheet width.

20. The process according to claim 18, wherein the sheet of yarns has at least about 40 yarn ends.

21. The process according to claim 20, wherein the sheet of yarns has 400 yarn ends or more.

22. The process according to claim 21, wherein the sheet of yarns has between 400 to 480 yarn ends.

* * * * *